United States Patent [19]

Dillman

[11] 4,249,679

[45] Feb. 10, 1981

[54] SEALING CLOSURE FOR ASPHALT MIX STORAGE BIN OUTLET

[75] Inventor: Bruce A. Dillman, Chien, Wis.

[73] Assignee: Bituma Stor, Inc., Marquette, Iowa

[21] Appl. No.: 9,290

[22] Filed: Feb. 5, 1979

[51] Int. Cl.[3] ..... B67D 3/02

[52] U.S. Cl. ..... 222/542; 222/561; 277/34.3; 137/246.22

[58] Field of Search ..... 277/DIG. 7, 34, 34.3, 277/34.6; 137/246.22; 220/211, 240, 345-347; 222/188, 542, 561, 555, 512, 152

[56] References Cited

U.S. PATENT DOCUMENTS

| | | | |
|---|---|---|---|
| 2,028,093 | 1/1936 | La Mont | 137/246.22 |
| 2,614,733 | 10/1952 | Anderson | 222/561 X |
| 2,865,393 | 12/1958 | Edge et al. | 137/246.22 X |
| 2,989,008 | 6/1961 | Lindstrom | 222/561 X |
| 3,820,687 | 6/1974 | Brock | 222/152 X |

*Primary Examiner*—David A. Scherbel

*Attorney, Agent, or Firm*—James E. Nilles; James R. Custin

[57] ABSTRACT

An asphalt mix storage bin outlet is surrounded by a rim member having a flat bottom surface in which there is an annular groove that extends around the outlet. An outlet closure comprises a plate-like edgewise slidable gate member mounted on rollers that ride on parallel rails at opposite sides of the outlet. The rails have long, straight portions along which the gate member rides to and from its open position with its top surface spaced below the bottom surface of the rim member, but as the gate member nears its closed position it rides up onto wedge-like portions of the rails that cam it towards snug engagement of its top surface with the bottom surface of the rim member. For an airtight seal with the gate member closed, grease is forced into the groove in the rim member, to be distributed around the outlet by the groove and thence forced into any space between the opposing surfaces of the rim member and gate member.

2 Claims, 7 Drawing Figures

SEALING CLOSURE FOR ASPHALT MIX STORAGE BIN OUTLET

FIELD OF THE INVENTION

The invention relates to bins or silos for the storage of asphalt paving mix and similar materials; and the invention is more particularly concerned with means for providing an airtight seal for an aperture in such a storage bin.

BACKGROUND OF THE INVENTION

Freshly mixed asphalt paving material is usually transferred from a pug mill or mixing drum to a storage bin or silo in which it is held until it is transported to a job site by truck. Storage of material in the bin allows the mixing and the trucking operations to be conducted on independent schedules.

The storage bin or silo is typically in the form of an upright generally cylindrical vessel having a conical bottom portion that converges down to an outlet controlled by a gate. The vessel is mounted to have its outlet high enough so that a truck can be driven under it to be loaded with material issuing directly from the outlet.

The gate that controls the silo outlet should be capable of opening and closing rather rapidly, so that the flow of material into a truck can be started and stopped quickly. The gate must also be capable of supporting a substantial vertical load, because when it is closed a portion of the weight of the material in the silo rests upon it.

In addition to these requirements, it is now mandatory in many areas that there be provision for a substantially airtight seal at the outlet of an asphalt mix storage bin if asphalt mix to be stored in it overnight or for other extended periods. The need for such a seal arises because asphalt paving mix must be kept at a temperature above 300° F. (over 140° C.) if it is to be prevented from hardening. To prevent cooling of the contents of an asphalt mix silo, such a silo is thermally insulated. But if there is any substantial air leakage at the bottom outlet of a silo, there could be a strong upflow of air through its interior, induced by the heat of its contents and the chimney effect of the silo walls, and such airflow could carry off enough heat to permit substantial hardening of the mix, especially in the downwardly tapering bottom portion of the silo through which the coolest air would flow. Needless to say, a plug of hardened asphaltic material near the bottom outlet of a silo would present a difficult and unpleasant problem.

There is some belief that for long-term storage of asphalt mix air should be purged out of the interior of the silo and totally excluded from it, on the theory that the asphaltic binder component of the mix tends to be oxidized in the presence of air, with consequent deterioration of its quality. On this theory, U.S. Pat. No. 3,348,739 discloses means for forcing pressurized inert gas into an asphalt mix silo to drive air out of it and maintain a nonoxidizing environment in its interior; and U.S. Pat. No. 3,820,687 discloses the circulation of air from and back to the silo interior through a charcoal burner by which the oxygen content of the air is converted to carbon dioxide.

There are indications, however, that little or no deleterious oxidation takes place during reasonably long term storage, provided the bottom outlet of the silo is sealed substantially airtight. Apparently such gases as are given off by the asphaltic binder material tend to displace residual air out of the silo interior, especially if the top inlet is not sealed airtight. If such gases are substantially inert, then the upper seal would not have to be particularly good, inasmuch as air does not tend to flow downwardly through it into the hot interior of the silo.

It is apparent, however, that a substantially airtight bottom outlet closure is essential for a silo in which asphalt mix is to be stored for long periods, whether or not possible oxidation of the binder material is a matter of concern. But the need for such a seal has heretofore been regarded as somewhat incompatible with the requirement that the closure gate for the bottom outlet be capable of rapid opening and closing, and also with the requirement that the gate be capable of supporting a substantial load when closed. Of course a completely satisfactory sealing closure for the bottom outlet should also be inexpensive and easy to manufacture and should require a minimum of maintenance.

One type of bottom closure for asphalt mix storage bins that has heretofore been devised in an effort to meet this complex of requirements is disclosed in U.S. Pat. No. 3,532,252, wherein the bottom outlet was normally closed by a pair of clamshell gates that swung toward and from one another. Around and beneath the outlet was a box-like structure that cooperated with the frustoconical bottom wall portion of the silo to form a chamber beneath the outlet. This chamber had a bottom opening that was aligned with the silo outlet and could be sealed closed by a second gate in the nature of a sliding door. The chamber and the silo were intended to be filled with inert gas; hence leakage through the clamshell gates was of no consequence inasmuch as the chamber beneath those gates served as a sort of air lock. Obviously it was expensive to provide the box-like chamber structure and the two sets of gates, and in addition the patent discloses a rather complicated control system, apparently needed to ensure, among other things, that the clamshell gates would not be opened while the lower sliding door gate was still closed.

A later arrangement for sealing a bottom outlet is disclosed in U.S. Pat. No. 3,949,907. The closure of that patent comprised a large clam shell gate that swung in an arc between open and closed positions. When the gate was closed, marginal portions of it extended upwardly and outwardly all around a downwardly projecting rim around the silo outlet, to cooperate with that rim in defining an annular trough around the outlet. If the gate was to remain closed for a substantially long time, oil was filled into this trough to provide a seal. The oil was drained out just before the gate was to be opened. The gate structure just described, in comprising an arcuately swinging gate member, required a curved bottom surface on the rim of the outlet, corresponding to the arc of swinging motion of the gate, and required the gate to be curved concentrically to its path of motion. The structure was therefore difficult and expensive to fabricate, and a somewhat complicated actuating mechanism was required for imparting swinging motion to the gate. Furthermore, because of the large size of the single swingable gate member, needed for defining the oil seal trough, it possessed substantial inertia and therefore was not well adapted for rapid opening and closing.

The earlier U.S. Pat. No. 3,532,252, in addition to its air-lock bottom closure seal, also disclosed a sealing closure for the top inlet. That closure comprised a flat, plate-like rectangular door which was edgewise slidable to and from a closed position over the silo inlet and which carried four small single-action pneumatic cylinder motors, one near each of its corners, each arranged to compress a strong coiled expansion spring. As the door was moved to and from its closed position, the pneumatic motors were energized to hold the springs compressed; but with the door in its closed position, air pressure on the motors could be relieved, and the springs would then expand, reacting against fixed structure on the silo to bias the door flatwise downward into firm engagement with the rim of the inlet.

A later U.S. Pat. No. 3,946,772 disclosed another slidable gate type of inlet closure, requiring only one pneumatic cylinder motor, arranged to impart edgewise sliding motion to the gate in its opening and closing directions. A rather complicated system of rollers, cam tracks and toggle links was relied upon to move the gate flatwise downward into firm engagement with the inlet rim after the gate had been moved edgewise into a position overlying the inlet opening.

It is noteworthy that the two sliding gate arrangements just described were intended for silo inlets. An inlet closure gate does not have to move into downwardly flowing asphalt mix and interrupt its flow, as with a conventional silo outlet closure; hence, both the gate itself and the rim of the inlet can be expected to remain reasonably clean. If particles of sand or the like can lodge between the gate member and the closure rim, they naturally maintain a space between those elements that prevents the attainment of an airtight seal.

U.S. Pat. No. 3,348,739, which taught the charging of pressurized inert gas into an asphalt silo, also disclosed an edgewise slidable gate for the silo bottom outlet, guided in opposite grooves in the fixed silo structure and intended to make wedging engagement in another groove when in its closed position. In that case the sliding gate did not have to move into the path of flowing asphalt mix because flow through the outlet was controlled by a worm conveyor that moved the mix substantially horizontally to the outlet. Nevertheless, it is doubtful whether the gate guiding grooves could have been kept sufficiently clean and free from asphalt mix to ensure consistent and troublefree operation of the closure.

The above discussed prior art demonstrates that the provision of a fully satisfactory sealing closure for an asphalt mix silo outlet has been far from obvious. The complicating factor is one that appears to be unique to closures for asphalt mix silos, namely the presence of asphalt mix, which is both sticky and gritty and the gritty particles of which, moreover, are extremely hard. Because of this complicating factor, the attainment of an airtight seal for an asphalt mix silo outlet has been thought to require structures, actuating mechanisms and control systems that were complicated and expensive.

SUMMARY OF THE INVENTION

The present invention has for its general object the provision of a sealing closure for the bottom outlet of an asphalt mix silo or storage bin that is simple in construction and inexpensive to manufacture, is inherently suitable for very rapid opening and closing, is well adapted for supporting the substantial force exerted by the contents of the silo, affords a substantially airtight seal for long-term retention of the silo contents, and, with all of this, is compatible with the constant and pervasive presence of gritty and sticky asphalt mix material.

Another object of this invention is to provide an outlet closure for an asphalt storage silo or the like that is extremely simple, inexpensive and sturdy by reason of its comprising mainly an edgewise moveable flat plate that can be readily actuated for opening and closing motion by air cylinder means connected to it in a direct and simple manner.

It is more specifically an object of this invention to provide a sliding gate closure for an asphalt mix storage bin opening that is adaptable to both inlet and outlet closures and comprises a plate-like gate member that is moveable substantially edgewise between open and closed positions, a simple actuator for imparting such motion to the gate member, and simple and inexpensive means for imparting a component of flatwise motion to the gate member when it is near its closed position so that when it is closed a flat, inwardly facing surface on it is firmly engaged against a flat opposing surface on a rim member surrounding the aperture, although the gate member is spaced from the rim member through most of its opening and closing motion.

A further specific object of this invention is to provide a closure of the character described that comprises a plate-like gate member that cooperates with the rim portion of a silo outlet, which closure can be sealed substantially airtight by means of a small amount of a sealing medium such as grease, injected between the rim portion and the gate member, said closure being so arranged that injection of the sealing medium can readily be effected automatically.

In general, insofar as the objects of the invention relate to provision of an edgewise slidable gate member which, in a closed position, has an inwardly facing flat surface thereon urged flatwise towards firm engagement with a flat outwardly facing surface on a rim member surrounding a bin opening, those objects are attained in structure characterized by a pair of parallel rails that are located at opposite sides of the opening and have straight, flat and parallel surface portions that extend in the opening and closing directions of gate member motion; two pairs of rollers on the gate member, one pair for each of the rails, said rollers being cooperable with said surface portions of the rails to support the gate member with its said surface spaced from the plane of said surface on the rim member and parallel thereto and to constrain the gate member to motion parallel to said plane in said directions, to and from an open position of the gate member in which it is at one side of said opening; actuating means for moving the gate member in said directions; and said rails further having oblique surface portions which are engaged by said rollers when the gate member is at and near a closed position in which it extends across said opening, said oblique surface portions being inclined inwardly of the bin and in the closing direction of gate member motion to impart to the gate member, during a final portion of its closing motion, a component of motion inwardly of the bin whereby said surface on the gate member is carried towards firm flatwise engagement against said surface on the rim member.

Insofar as the objects of the invention relate to the provision of an airtight seal around an opening in an asphalt storage bin having a rim member surrounding said opening and a gate member with a flat inwardly facing surface that opposes an outwardly facing surface on the rim member when the gate member is in its closed position, those objects of the invention are achieved in a storage bin having an annular groove in one of said members, opening to its said surface and extending around the opening; and means for forcing grease into said groove under pressure at locations that are spaced from one another around the groove so that the groove serves to distribute grease all around the outlet and the grease fills any space between said surfaces to provide a substantially airtight seal all around the outlet.

BRIEF DESCRIPTION OF DRAWINGS

In the accompanying drawings, which illustrate a preferred embodiment of the invention.

Figure 2:
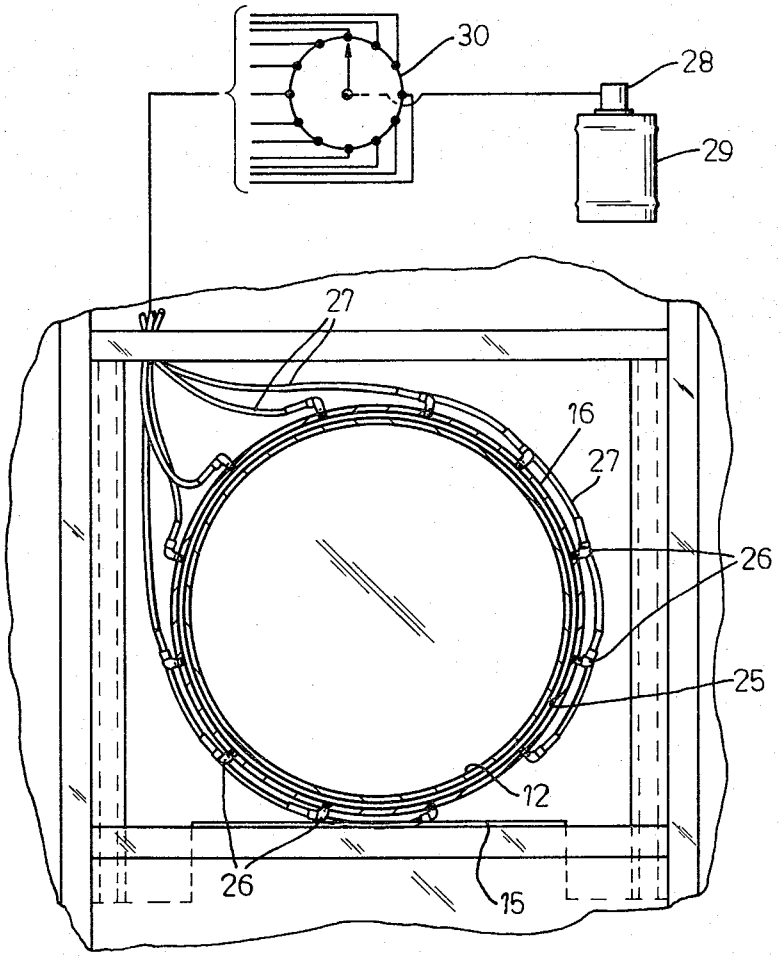
FIG. 2 is a view in cross-section, on an enlarged scale, taken on the plane of the line 2—2 in FIG. 1.
Figure 1:
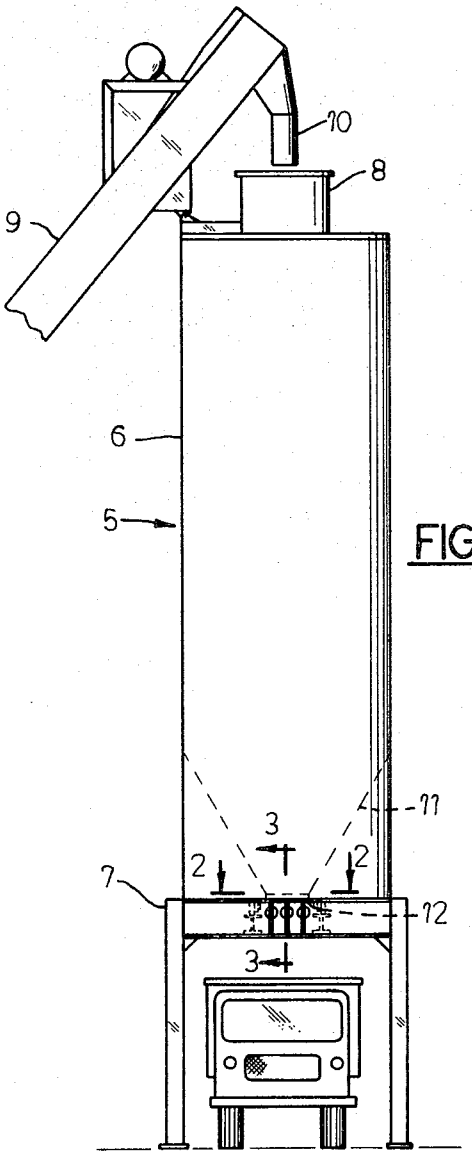
FIG. 1 is a view in elevation of an asphalt mix storage bin or silo that embodies the principles of the present invention.
Figure 3:
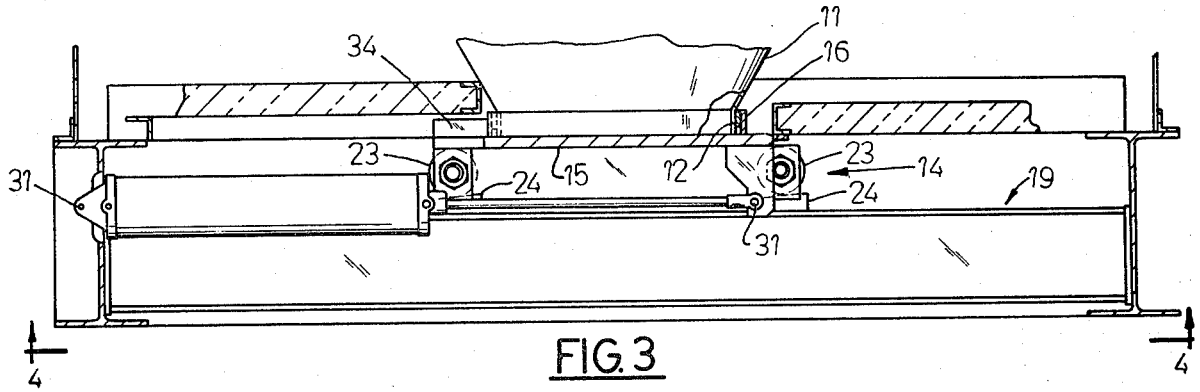
FIG. 3 is a view in vertical section, likewise on an enlarged scale, taken on the plane of the line 3—3 in FIG. 1 and showing the gate member in its closed position.
Figure 4:
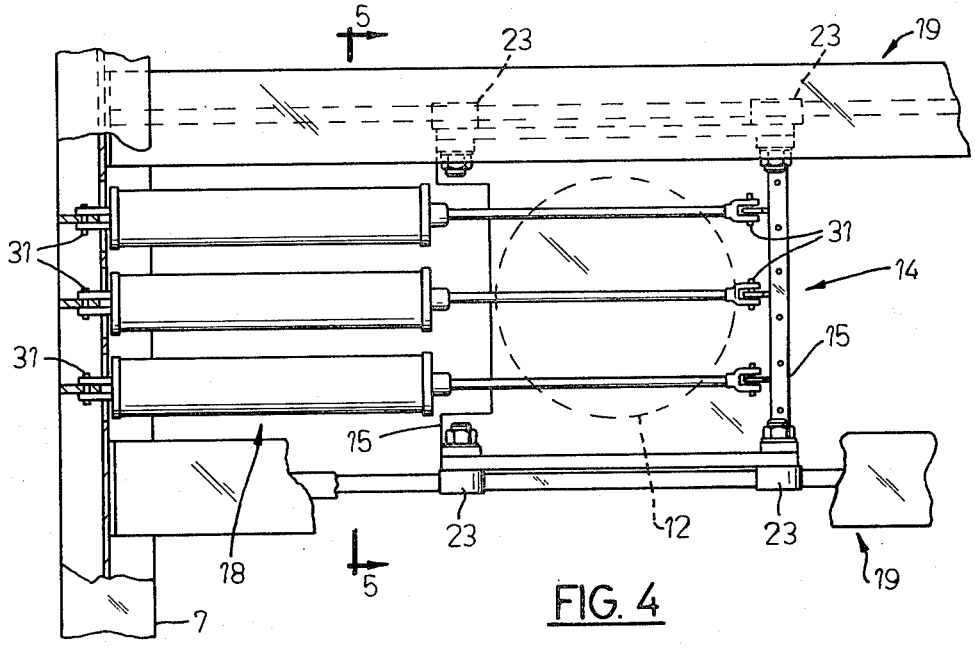
FIG. 4 is a view looking upward towards the bottom of the bin, taken on the plane of the line 4—4 in FIG. 3.
Figure 5:
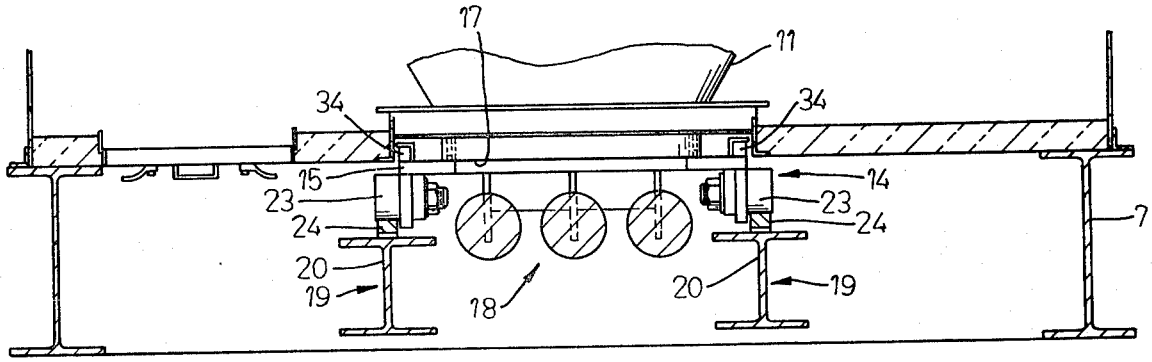
FIG. 5 is a fragmentary view in vertical section taken on the plane of the line 5—5 in FIG. 4.
Figure 6:
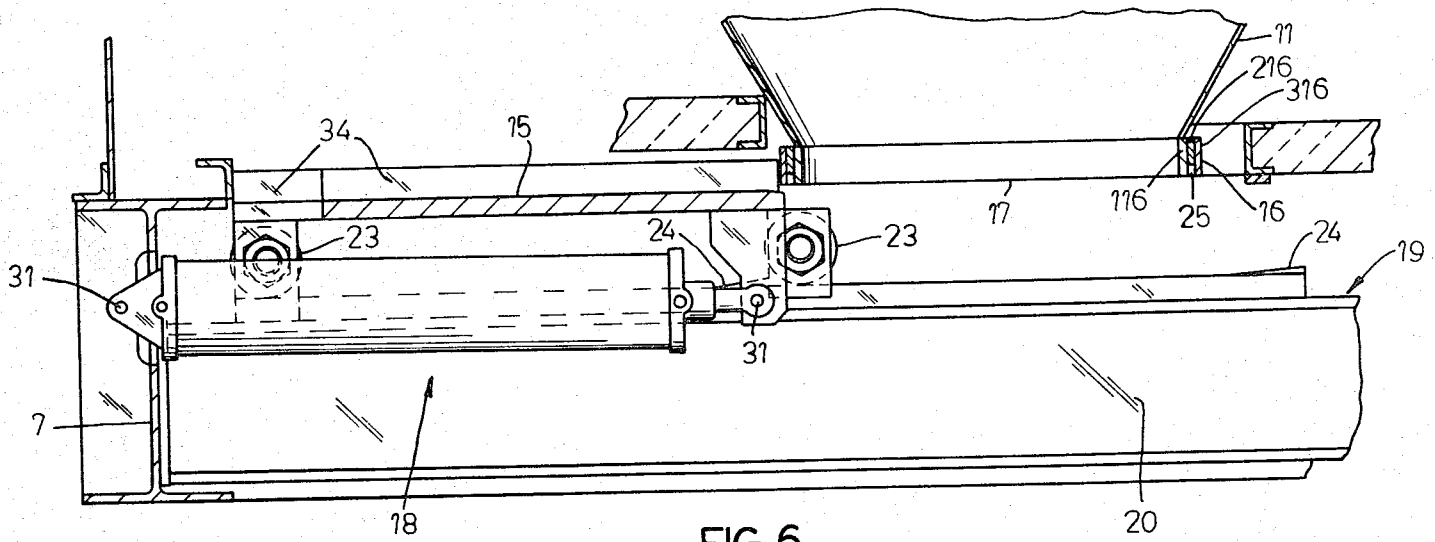
FIG. 6 is a view generally like FIG. 3, but on a larger scale and showing the gate member in its open position.
Figure 7:
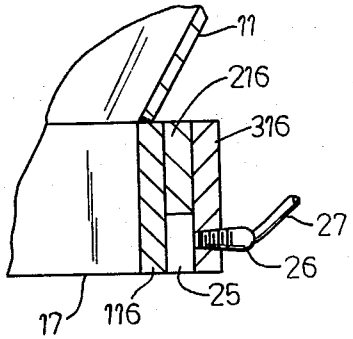
FIG. 7 is a fragmentary view in vertical section, on a further enlarged scale, taken through a portion of the rim member at the connection thereto of one of the grease fittings.

Referring now to the accompanying drawings, the numeral 5 designates generally an asphalt mix storage bin or silo embodying the principles of this invention, illustrated as comprising an upright, generally cylindrical vessel 6 that is supported above ground level on a foundation frame 7. Asphalt mix to be stored in the silo 5 is filled into an inlet 8 in the top of the vessel 6 by means of a conveyor 9 which extends up alongside the silo and partway across its top and which discharges into a down chute 10 whereby the material is guided into the inlet.

The lower portion 11 of the vessel 6 is frustoconical, converging downwardly to a concentric outlet opening 12. The foundation frame 7 supports the vessel 6 at a height such that trucks can be driven under it to be filled directly from its outlet.

The outlet opening 12 is normally closed by means of a gate designated generally by 14, comprising a flat and plate-like horizontal gate member 15 that is mounted for mainly edgewise motion between an open position wholly spaced to one side of the outlet opening and closed position extending across the outlet opening and blocking it.

The outlet opening 12 is surrounded by an annular rim member 16 that forms a bottom end of the frustoconical lower portion 11 of the vessel 6, and when the plate-like gate member 15 is in its fully closed position, its flat upper face opposes and tends to flatwise engage a coplanar bottom surface 17 on that rim member. Opening and closing motion is imparted to the gate member 15 by actuating means 18 illustrated as a double-acting pneumatic cylinder mechanism.

The gate member 15 is preferably square or rectangular in planform and large enough to project a substantial distance beyond the rim member 16, all around the same, when the gate is closed. The gate member 15 is carried for its opening and closing motion on a pair of rails 19 that extend parallel to one another across the foundation frame 7, at opposite sides of the outlet opening 12. Each of the rails 19 preferably comprises an I-beam that has a deep upright web 20 and is thus well adapted to sustain the large downward loads imposed upon it by the gate. Rollers 23 on the gate member, one near each of its corners, ride on the upper surfaces of the I-beams.

The rail surface along which each roller 23 rides is horizontal along most of its length, and when the rollers are engaged with these horizontal surface portions of the rails, the gate member 15 has its upper face spaced a small distance below the plane of the bottom surface 17 of the rim member 16, so that the gate member can be moved very quickly and easily through most of its stroke during both opening and closing. However, as the gate member approaches its closed position, each of its rollers 23 rides up onto an upwardly inclined wedge-like cam surface portion 24 of its rail, whereby an upward component of motion is imparted to the gate member that tightly engages its upper face against the bottom surface 17 of the rim member 16. Since all four of the rollers 23 that support the gate member ride up simultaneously onto identical cam surface portions 24, the upward motion of the gate member is a substantially translatory one in which its upper face remains horizontal.

It will be observed that the limit of closing motion of the gate member is defined by its firm engagement, under wedging force, against the rim member 16. Although such engagement will afford an adequate seal for short-term asphalt storage, it cannot be relied upon for the airtightness needed for long-term storage because of the possibility of a certain amount of asphalt mix material being trapped between the gate member and the rim member to maintain a slight spacing between those members that would permit air to leak into the outlet. Hence, if the outlet 12 is to remain closed for a prolonged period during which asphalt mix is stored in the silo, then, according to the present invention, grease is injected under pressure between the opposing flat surfaces of the gate member 15 and the annular rim member 16, to fill any space between them and provide an air seal around the outlet.

For such grease injection, the rim member 16 is formed with a groove 25 that opens downwardly to its bottom face, and grease fittings 26, communicable (as explained hereinafter) with a source of grease under pressure, open to this groove from the outside of the rim member for injection of grease into the groove. To define the groove 25, the rim member 16 can be made up of three concentric, axially short, cylindrical rings 116, 216 and 316 that fit closely within one another. The radially innermost ring 116 and the radially outermost ring 316 are axially deeper than the intermediate ring 216, and the deeper rings 116 and 316 have their bottom ends coplanar to define the flat bottom surface 17 of the rim member. The axially shallower intermediate ring 216 has its bottom end spaced above the bottom ends of the other two rings and thus cooperates with them to define the groove 25.

The grease fittings 26 are threaded into circumferentially spaced holes in the outer ring 316 that open to the groove 25. Pressure hoses 27, one for each grease fitting 26, provide for communication of the several fittings with a grease pump 28 that can be similar to the grease pumps used for chassis lubrication in automotive maintenance shops. The grease pump 28 draws grease from a supply thereof, illustrated as a drum 29, and feeds it into an electrically timed distributor valve 30 that directs the output of the pump into each of the hoses 27 in turn, each for a predetermined time. The grease is thus forced into the groove 25 under sufficient pressure to flow circumferentially partway around the groove from each grease fitting 26, to be distributed all around the outlet by the groove and also to be forced a distance radially from the groove into any space between the rim member 16 and the gate member 15.

Only a relatively small amount of grease is injected each time the silo outlet 12 is sealed, and such small quantities of grease as may adhere to the gate member 15 when it is opened are not deleterious to the asphalt mix; hence there is no need to withdraw or remove the injected grease before the gate is opened.

The actuating means 18 for the gate member 15 is shown as comprising three laterally spaced double-acting pneumatic cylinder devices, each having its cylinder connected to the foundation frame 7 and its piston connected to the gate member 15, near the edge of the gate member that is forward during gate closing motion. Three such cylinder devices are used, rather than a single large one, for greater vertical compactness and for a better distribution of closing and opening forces across the width of the gate member. To accommodate the vertical components of gate member motion as the gate member rides up and down the wedging surfaces 24 of the rails, the connections 31 of the cylinder devices to the frame and to the gate member are pivotal ones.

As mentioned above, the gate member 15 is of such size that, when closed, it projects a distance beyond the rim member 16 all around the same. Hence any material that falls onto the gate member during its closing motion, or leaks out onto it after it is closed, will tend to remain on top of the gate member rather than spilling down onto the rollers 23 or the pneumatic cylinder devices 18. In addition, the gate member has wall-like upward projections 34 along both side edges and along its edge that is rearmost during closing motion, and these further prevent spillage of such material off of the upper face of the gate member.

From the foregoing description taken with the accompanying drawings it will be apparent that this invention provides a simple and inexpensive but very sturdy closure for the bottom outlet of a storage bin for asphalt mix and the like, which closure is capable of rapid opening and closing movement and is also capable of affording an effective airtight seal around the outlet for long term storage of material in the bin.

Those skilled in the art will appreciate that the invention can be embodied in forms other than as herein disclosed for purposes of illustration.

I claim:

1. A sealing closure for a bottom outlet in a bin for storage of asphalt paving mix, said closure comprising:

A. an annular rim member on the bin, surrounding said outlet, said rim member having coplanar downwardly facing radially inner and radially outer bottom surfaces extending therearound that are separated from one another by a downwardly opening groove extending around the rim member;

B. a gate member having a flat top surface engageable with said bottom surfaces on the rim member;

C. mounting means supporting the gate member with its top surface substantially parallel to the plane of said bottom surfaces on the rim member and for motion of the gate member in opposite closing and opening directions substantially parallel to its top surface, toward and from an open position in which the gate member is at one side of said outlet;

D. actuating means for moving the gate member in said directions;

E. cooperating motion translating means on the mounting means and on the gate member for imparting to the gate member an upward component of motion during a final portion of movement of the gate member in its closing direction, to bring the gate member to a closed position in which it extends across the outlet and in which its top surface is urged towards firm engagement with said bottom surfaces on the rim member; and F. means for forcing grease under pressure into said groove, at spaced locations around the groove, so that when the gate member is in its closed position the groove can distribute such grease all around the outlet and into any space between the top surface of the gate member and said bottom surfaces on the rim member, where the grease provides a seal around the outlet.

2. The sealing closure of claim 1, further characterized by:

(1) said mounting means comprising (a) a pair of parallel rails extending in said opening and closing directions, (b) two pairs of rollers on the gate member, one pair for each of said rails, said rollers being cooperable with said rails to support the gate member with its top surface parallel to said bottom surfaces on the rim member and to guide the gate member for motion in said directions; and (2) said motion translating means comprising surface portions on said rails which are engaged by said rollers when the gate member is at and near its closed position and which are inclined upwardly and in said closing direction to impart a component of upward motion to the gate member as it moves to its closed position and thereby cammingly urge the top surface on the gate member towards firm engagement with said bottom surface on the rim member.

* * * * *